United States Patent [19]

Souville et al.

[11] 4,090,761

[45] May 23, 1978

[54] CONNECTOR WITH REMOTE CONTROL LOCKING SYSTEM

[75] Inventors: Pierre Souville, Boulogne-Billancourt; Jean-Pierre Baudouin, Evreux, both of France

[73] Assignee: Compagnie Deutsch, Saint-Cloud, France

[21] Appl. No.: 781,356

[22] Filed: Mar. 25, 1977

[30] Foreign Application Priority Data

Mar. 26, 1976 France ..... 76 08822

[51] Int. Cl.[2] ..... H01R 13/54

[52] U.S. Cl. ..... 339/90 R; 339/113 R

[58] Field of Search ..... 339/89 A, 90 R, 91 R, 339/91 B, 113 R, 113 L

[56] References Cited

U.S. PATENT DOCUMENTS

| | | | |
|---|---|---|---|
| 2,198,504 | 4/1940 | Pool | 339/91 B |
| 3,693,136 | 9/1972 | Appleton | 339/91 B |
| 3,960,428 | 6/1976 | Naus et al. | 339/113 L X |

*Primary Examiner*—Roy Lake
*Assistant Examiner*—E. F. Desmond
*Attorney, Agent, or Firm*—Darby & Darby

[57] ABSTRACT

An electrical connector having first and second interfitting sections, a locking member movable with respect to said sections and having two stable positions one for locking the two sections together and the other for unlocking the two sections. An electric contact is carried by one of said sections to provide an indication of the locked or unlocked status of the connector which is closed by said locking member as it reaches the locking position and opened as it reaches the unlocked positon.

6 Claims, 6 Drawing Figures

CONNECTOR WITH REMOTE CONTROL LOCKING SYSTEM

The present invention relates to electrical connectors, that is, devices for rapid coupling or separation of a multiplicity of electric conductors. Such devices generally comprise two parts which fit one in the other, one having sockets and the other having pins which insert themselves in the sockets.

When these two parts can be coupled and uncoupled by simple pushing and pulling, the connector is called a "push-pull" type. Other devices requiring a twisting or rotating movement.

A device of the "push-pull" kind is described in French Pat. No. 2,248,460 filed on Oct. 19, 1973, in the name of Compagnie Deutsch. The devices described in that patent include on the one hand locking means for the two fixed and moveable parts in connected position and on the other hand control means as indication of such locking. In particular, when the connector is in locked position an outer slide freely rotates about the connector, while the slide is blocked when the connector is unlocked. On the other hand, a visual control can be established in that the outer slide uncovers a color mark when it is in locking position while this mark is covered and hidden by the slide when the connector is unlocked.

Such indicator devices (optical control or manual control) fulfill their role when the connector is accessible. But sometimes situations occur in which the location of the connector is such that it is difficult, or even impossible, to use such an indicator.

The present invention serves to remedy this drawback and relates to a remote control system for indicating the locking of a connector. In accordance with the invention, one of the two parts of the connector includes an electric contact and means are provided to close this contact against an elastic return when the connector reaches the locked position, said contact opening automatically as soon as the connector leaves the locking position. This arrangement makes it possible to remotely indicate the locking of the connector, for example by means of any signal such as a telltale light which goes on or extinguishes when the connector is locked.

The invention relates more specifically to a connector of the "push-pull" type in which connection between the two fixed and movable parts of the connector is assured by balls carried by one of the parts, referred to as the movable part, cooperating with seats carried by the other part, referred to as the fixed part, these balls being maintained in place in said seats by a slide sliding on the movable part when the connector is locked. In the preferred embodiment, the movable part includes an additional ball, lodged in an insulating movable cup sliding in the wall of said movable part, this ball being subjected to the action of a ramp carried by the sliding slide so as to form an electrical contact carried by said movable part when the slide reaches the locking position, said contact opening automatically under the effect of an elastic return when the slide leaves the locking position.

The invention also includes the following arrangements:

(a) The electric contact is formed of two contact studs mounted on respective elastic arms lodged in the movable part, one of these arms acting as a spring pushing the ball and its cup toward the ramp carried by the slide so as to maintain constant contact between ball and ramp.

(b) The above two arms are mounted on one of the electric contacts of the connector whose continuity is interrupted by an insulating block connecting said arms.

(c) The cup carrying the ball includes a peripheral lip assuring tightness against outside overpressure at the collector.

The invention is described below with reference to the annexed drawing, in which.

Figure 3:
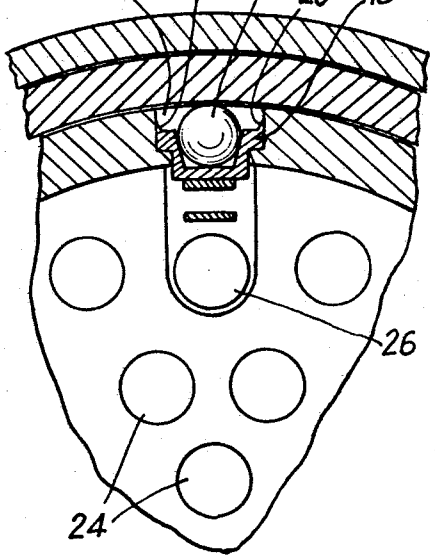
FIG. 3 is a partial sectional view along A—A of FIG. 1.
Figure 1:
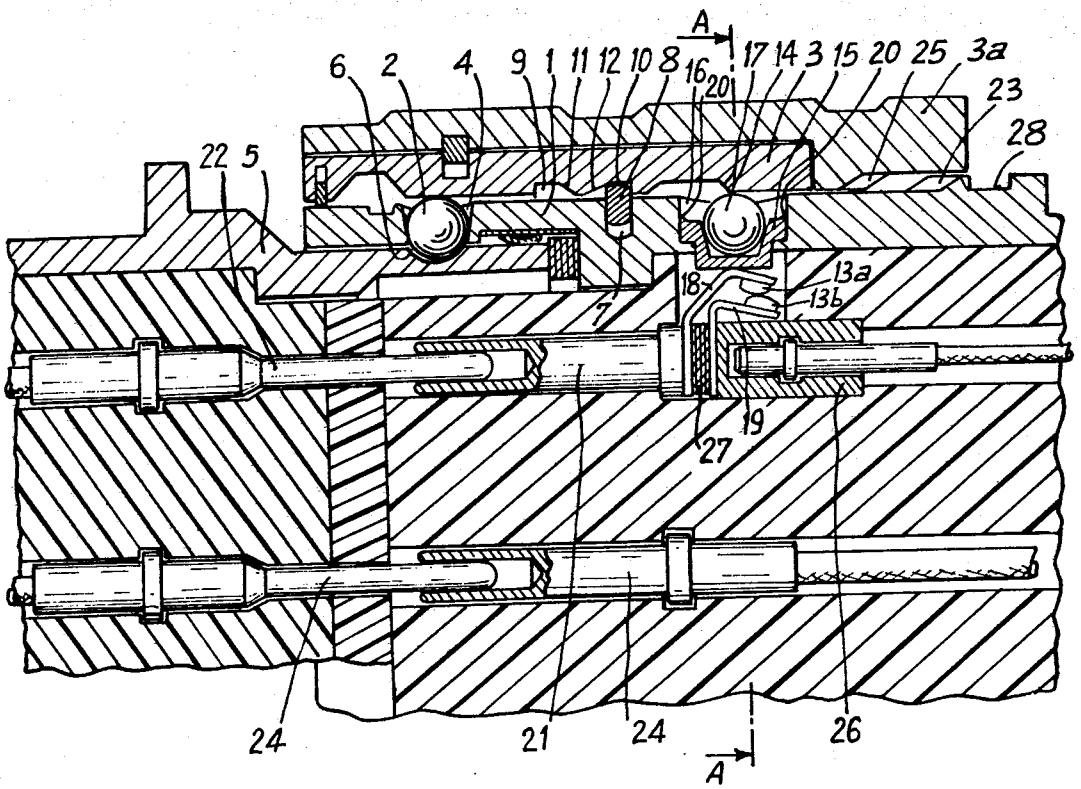
FIG. 1 is a view in partial longitudinal section, in locking position, of a connector of the type described in French Pat. No. 2,248,460 equipped with the indicator means.
Figure 2:
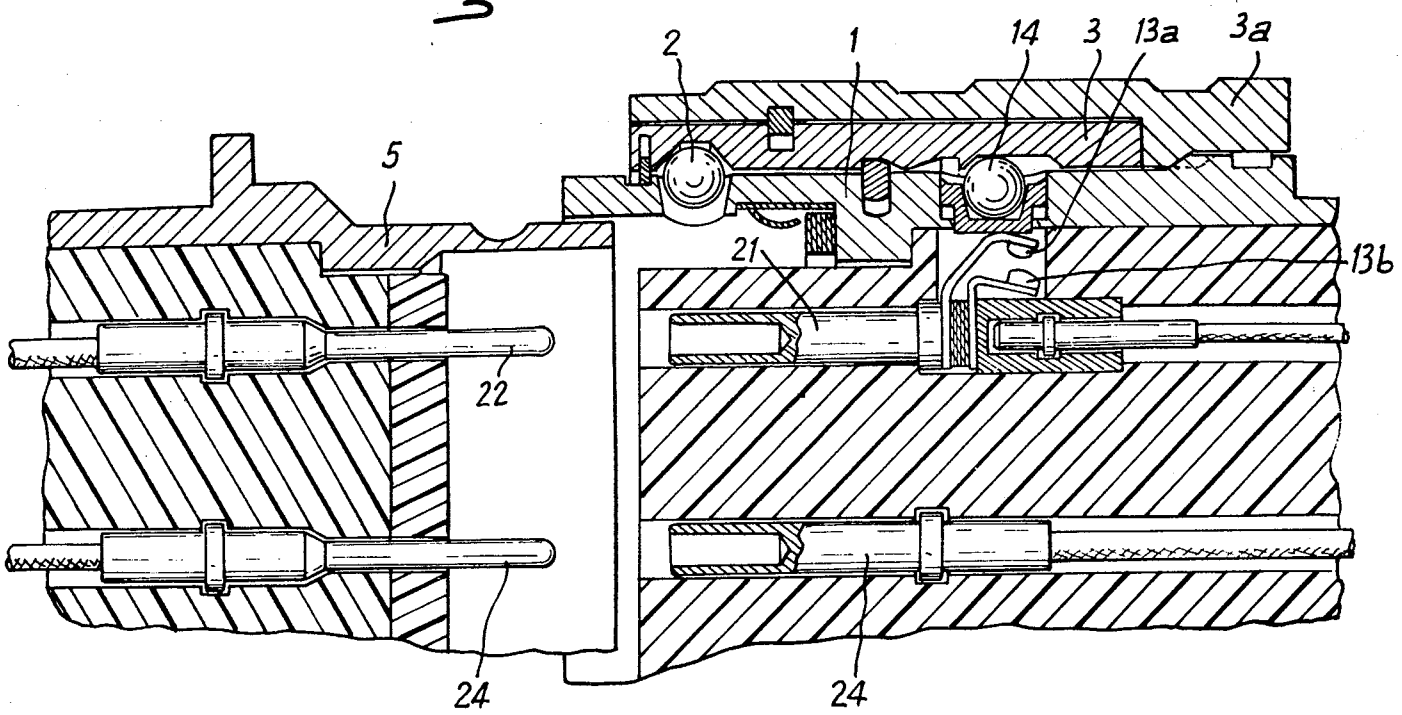
FIG. 2 is a view similar to FIG. 1, in unlocked position.

Referring to FIGS. 1 to 3, it is seen that the connector includes a movable part 1 shown as a socket, carrying balls 2 around its periphery (only one of which is shown) whose diameter is greater than the thickness of th socket. The balls 2 can therefore project from the interior of the movable part 1, notably when they are pushed back by a sliding slide 3. The openings 4 for balls 2 are conical so as to limit the movement of the balls 2 toward the interior of the movable part 1.

The connector includes further a fixed part 5 with connector pins 24 capable of inserting itself into the movable part 1. This fixed part 5 has depressions or seats 6 in which the balls 2 fit when the connector is in locking position. They are then maintained in this position by the slide 3 engaging the balls as shown in FIG. 1 and the movable part 1 cannot be extracted from the fixed part 5.

The connector thus described is the same as that in French Pat. No. 2,248,460 and it comprises a locking system formed of a circumferential groove 7 in socket 1 in which is lodged an elastic retaining ring 8 which rests, by elasticity, on the inner face of slide 3. On the inner face of slide 3 are formed two grooves 9 and 10 separated by two ramps, namely the locking ramp 11 and the unlocking ramp 12, inclined oppositely of each other so as to define for ring 8 two stable extreme positions without an intermediate stable position.

With this device as heretofore described, the locking indication occurs in two ways:

(a) First the advance of slide 3 in locking position (FIG. 1) uncovers the annular surface 28 which is covered with a special color or any other suitable mark.

(b) Second, when the slide is in unlocked position, the teeth 23 of the movable part cooperate with the teeth 25 of the outer part 3*a* of the slide, which can then no longer rotate (see FIG. 2). When slide 3 is in locking position, the teeth 23 and 25 are not engaged and the outer part 3*a* of the slide can be rotated about its inner part.

These two modes of indication, the first visual, the second manual, work perfectly as long as the device is accessible, as has been stated above.

According to the invention, the device includes a third locking control indication, remote control indication usable even when the connector is inaccessible. This indication operates by providing one of the two fixed and movable parts 5 and 1 with an electric contact 13. Means are provided to close this contact against an elastic return when the connector reaches the locking position.

In the preferred embodiment, the contact closing means are formed by a ball 14 held in an insulating cup 15 which slides in a bore 16 of the movable part 1. A circumferential ramp 17 is provided in slide 3 and disposed to cooperate with the ball 14 and to push the latter in when the slide reaches the end zone of the locking movement, that is, when ring 8 is definitely engaged on ramp 12, in the direction of groove 10. During the unlocking, movement of ball 14 is released before the elastic ring 8 reaches the summit of ramp 12 and engages on ramp 11.

The electric contact 13 is formed by contact studs 13*a* and 13*b* carried by electrically conductive elastic arms 18 and 19 separated by an insulating block 27. Arm 18, on which cup 15 acts, is formed in such a way to produce a return force is sufficient for constantly pushing cup 15 and ball 14 against ramp 17 of the slide, despite frictional forces or external pressure.

For device to be tight, cup 15 carries terminal lips 20 which are applied by the external pressure against the wall of the hole 16 in which cup 15 slides.

In the example shown, contact 13*a* is located on one of the contacts carried by the connector, in the instance contact 21 of the movable part 1 which cooperates with the contact 22 of the fixed part 5. The other contacts 24 of the connector are made in the usual manner. Contact 21 is interrupted and divided in two parts 21 and 26 separated by the insulating block 27, the arms 18 and 19 being mounted respectively on the parts 21 and 26 of said contact.

The operation of the device is described as follows. When the connector is locked, at the moment when slide 3 reaches the locking position, ball 14 is engaged and pushed down by ramp 17. It pushes cup 15 against the return of arm 18 until the studs 13*a* and 13*b* of contact 13 touch. Current can then flow in contacts 21 and 22 to trigger any appropriate light, sound or other signal. As soon as slide 3 leaves the locked position sufficiently, the ball 14 comes off ramp 17, arm 18 pushes cup 15 upwardly and contact 13 opens. This causes a corresponding signal or the stopping of the preceding signal.

Figure 4:
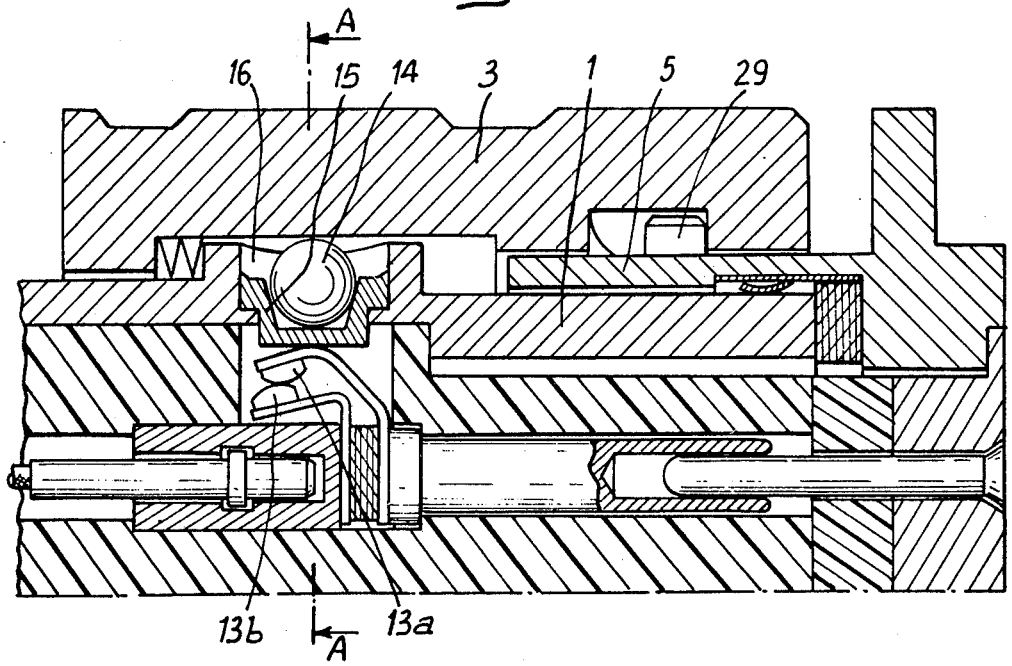
FIG. 4 is a view in partial longitudinal section, in locking position, of a connector of the bayonet type.
Figure 5:
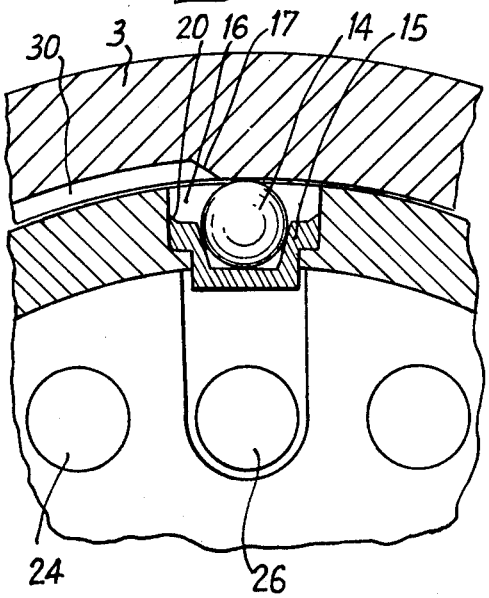
FIG. 5 is a view in partial section along A—A of the device of FIG. 4 in locking position.
Figure 6:
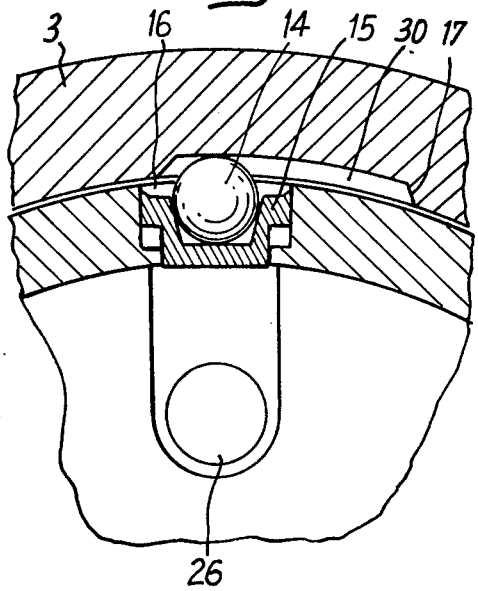
FIG. 6 is a view similar to FIG. 5 of the device in unlocking position.

In the embodiment shown in FIGS. 4 to 6, the connector is of the bayonet type. The socket carrying part 5 places itself on the pin carrying part 1, the movable slide 3 operating by rotation around part 1 so as to interact with the nipples 29 carried by part 5. Ball 14 and cup 15 are lodged in a bore 16 of part 1 and act on the contact 13*a*, 13*b* in the same manner as previously described for the device of FIGS. 1 to 3.

In the embodiment of FIGS. 4 to 6, the ramp 17 terminates at a groove 30 which occupies a sector of the circumference of slide 3. The depth of groove 30 and the positioning of ramp 17 are such that the ball 14 is driven in by ramp 17 (to reach the position of FIGS. 4 and 5) only at the end of the locking movement of slide 3.

What is claimed is:

1. An electric connector comprising first and second interfitting sections, each section carrying at least one electrical contact means for connection to a contact means in the other section, locking means for coupling said first and second sections, said locking means including means for establishing a stable locking position for said sections and a stable unlocking position with positions of instability separating said locking and unlocking positions, auxiliary electrical contact means carried by one of said sections and having a spring contact member which is movable to control said contact means between open and closed positions, means for moving said movable member to one of said open and closed positions when said locking means is in the stable locking position and to the other of said positions when said locking means is in the stable unlocking position, said moving means comprising a bore formed in one of said connector sections, a ball movable in said bore for engaging said movable spring contact member, insulating means between said ball and said spring contact member and a ramp formed on said locking member for engaging said ball to move the ball inwardly and outwardly of the section as the locking ring is moved from one stable position to the other, said spring contact member urging said ball towards said ramp.

2. An electric connector comprising first and second interfitting sections, each section including a body portion of electrical insulating material carrying a plurality of electrical contact means for connection to a corresponding contact means in the body portion of the other section, locking means for coupling said first and second sections, said locking means including means for establishing a stable locking position for said sections when the corresponding electrical contact means of said first and second interfitting sections are electrically connected and a stable unlocking position where the electrical contact means of the first and second sections are unconnected with positions of instability separating said locking and unlocking positions, auxiliary electrical contact means located in and carried by the body portion of one of said sections and having first and second electrically insulated members one of which is movable to control said contact means between electrically open and closed positions, one of said members of said auxiliary contact means being electrically connected to one of said first named electrical means of said one section and the other of said members being electrically connected to a connector means adapted for connection to an indicator circuit, and means engageable by said locking means for moving said movable member to one of said open and closed positions when said locking means is in the stable locking position and to the other of said positions when said locking means is in the stable unlocking position.

3. A connector as in claim 2 wherein said means for moving said movable member of said auxiliary contact means comprises, a bore formed in one of said connector sections, a ball movable in said bore for engaging said movable member, and a ramp formed on said locking member for engaging said ball to move the ball inwardly and outwardly of the section as the locking ring is moved from one stable position to the other.

4. An electric connector comprising first and second interfitting sections, each section carrying at least one electrical contact means for connection to a contact means in the other section, locking means for coupling said first and second sections, said locking means including means for establishing a stable locking position for said sections and a stable unlocking position with positions of instability separating said locking and unlocking positions, auxiliary electrical contact means carried by one of said sections and having one member which is movable to control said contact means between open and closed positions, and means for moving said movable member to one of said open and closed positions when said locking means is in the stable locking position and to the other of said positions when said locking means is in the stable unlocking position, said moving means comprising a bore formed in one of said connector sections, a cup of electrical insulating material movable in said bore for engaging said movable member, a ball located in said cup, and a ramp formed on said locking member for engaging said ball to move the ball inwardly and outwardly of the section as the locking ring is moved from one stable position to the other.

5. An electrical connector as in claim 4 wherein said movable member comprises a spring contact engaging said cup and urging said cup towards the ramp of said locking means.

6. An electrical connector as in claim 4 wherein means are provided on said locking means to limit the travel of said cup in said bore.

* * * * *